US007757647B2

(12) United States Patent
Tanabe et al.

(10) Patent No.: US 7,757,647 B2
(45) Date of Patent: Jul. 20, 2010

(54) VARIABLE VALVE APPARATUS OF INTERNAL COMBUSTION ENGINE

(75) Inventors: Mikio Tanabe, Obu (JP); Shinichi Murata, Okazaki (JP)

(73) Assignee: Mitsubishi Jidosha Kogyo Habushiki Kaisha, Tokyo (JP)

( * ) Notice: Subject to any disclaimer, the term of this patent is extended or adjusted under 35 U.S.C. 154(b) by 434 days.

(21) Appl. No.: 12/010,378

(22) Filed: Jan. 24, 2008

(65) Prior Publication Data

US 2008/0133106 A1 Jun. 5, 2008

Related U.S. Application Data

(63) Continuation of application No. PCT/JP2006/314681, filed on Jul. 25, 2006.

(30) Foreign Application Priority Data

Jul. 25, 2005 (JP) ..... 2005-214325

(51) Int. Cl.
*F01L 1/18* (2006.01)

(52) U.S. Cl. ..... 123/90.39; 123/90.16; 123/90.33; 123/90.44; 74/569

(58) Field of Classification Search ..... 123/90.16, 123/90.27, 90.33, 90.34, 90.39, 90.44, 90.31; 74/559, 567, 569

See application file for complete search history.

(56) References Cited

FOREIGN PATENT DOCUMENTS

| | | | |
|---|---|---|---|
| JP | 56-56914 | A | 5/1981 |
| JP | 2003-239712 | A | 8/2003 |
| JP | 2004-132260 | A | 4/2004 |
| JP | 2005-299536 | A | 10/2005 |
| JP | 2005-325786 | A | 11/2005 |
| JP | 2006-152926 | A | 6/2006 |

*Primary Examiner*—Ching Chang
(74) *Attorney, Agent, or Firm*—Birch, Stewart, Kolasch & Birch, LLP

(57) ABSTRACT

A variable valve apparatus uses a camshaft provided rotatably in an internal combustion engine, and has a cam, a rocking cam driven by a cam, a intake valve or an exhaust valve driven by the rocking cam, a control shaft rotatably provided side by side with the camshaft in the engine, and has an oil passage inside to flow oil, a control arm whose one end is held by the control shaft, and the other end is projected from the control shaft, an actuator which rotates the control shaft, and displaces the control arm, a transmission arm which is rotatably connected to the other end of the control arm, and transmits the displacement of the control arm to the rocking cam, and a lubricant passage which is provided inside the control arm, and supplies oil in the oil passage to a part connecting the control arm and transmission arm.

8 Claims, 12 Drawing Sheets

VARIABLE VALVE APPARATUS OF INTERNAL COMBUSTION ENGINE

CROSS-REFERENCE TO RELATED APPLICATIONS

This is a Continuation Application of PCT Application No. PCT/JP2006/314681, filed Jul. 25, 2006, which was published under PCT Article 21(2) in Japanese.

This application is based upon and claims the benefit of priority from prior Japanese Patent Application No. 2005-214325, filed Jul. 25, 2005, the entire contents of which are incorporated herein by reference.

BACKGROUND OF THE INVENTION

1. Field of the Invention

The present invention relates to a variable valve apparatus of an internal combustion engine capable of changing a phase or amount of lift of a intake valve or an exhaust valve.

2. Description of the Related Art

A reciprocating engine mounted in an automobile as an example of an internal combustion engine is provided with a variable valve apparatus, which changes the phases or the open/close timing of a intake valve and an exhaust valve, and the amount of lift of the valves, in order to reduce exhaust gas and to enhance fuel efficiency of the engine.

Many of such variable valve apparatuses have a structure to change the characteristics of a intake valve and an exhaust valve by replacing the phase of a cam formed in a camshaft by a rocking-reciprocating cam comprising a continuous base circle section and a lift section.

Recent valve apparatuses have a structure such that a control arm is supported by a rotatable control shaft, and a transmission arm contacting a cam is supported at an end portion of the control arm, in order to reduce a pumping loss. In this structure, when a control shaft is rotated, a transmission arm is moved, which changes the position at which the cam and transmission arm come into contact. Thus, phases of a intake valve and an exhaust valve are changed, especially largely changed in a valve-closed period compared with a valve-opened period (refer to Jpn. Pat. Appln. KOKAI Publication No. 2003-239712, for example).

BRIEF SUMMARY OF THE INVENTION

Many variable valve apparatuses having a function of changing a valve-closed period largely compared with a valve-opened period have a support structure to fit a control arm into the periphery of a control shaft, as shown in Patent Document 1.

In such a variable valve apparatus, it is indispensable to supply a lubricant to sliding portions of each member. Particularly, it is necessary to supply a lubricant to a part supporting a control arm and a transmission arm. However, Patent Document 1 does not describe a measure for supplying a lubricant to such a part. Further, as characteristics of a valve are changed, such a support part is moved, a lubricant is not sufficiently supplied, and a structure to supply a lubricant becomes complex.

Accordingly, it is an object of the present invention to provide a variable valve apparatus for an internal combustion engine capable of lubricating a part to support a control arm and a transmission arm, while ensuring sufficient lubrication by a simple structure.

The present invention comprises a camshaft provided rotatably in an internal combustion engine; a cam formed in the camshaft; a rocking cam which is provided movably in the combustion engine, and driven by the cam; a intake valve or an exhaust valve driven by the rocking cam; a control shaft which is rotatably provided side by side with the camshaft in the combustion engine, and has an oil passage inside to flow oil; a control arm whose one end is held by the control shaft, and the other end is projected from the control shaft; an actuator which rotates the control shaft, and displaces the control arm; a transmission arm which is rotatably connected to the other end of the control arm, and transmits the displacement of the control arm to the rocking cam; and a lubricant passage which is provided inside the control arm, and supplies oil in the oil passage of the control shaft to a part connecting the control arm and transmission arm.

According to this configuration, the part connecting the control arm and transmission arm requiring lubrication can be lubricated simply by supplying oil from the oil passage of the control shaft to the lubricant passage formed inside the transmission arm. Therefore, a connected part is sufficiently lubricated by a simple oil passage structure.

A preferable embodiment of the invention further has an adjustment mechanism, which adjusts a distance from the part connecting the control arm and transmission arm to the axial center of the control shaft.

According to this configuration, variations in control and between cylinders is adjusted with high precision, by adjusting the distance from the part connecting the control arm and transmission arm to the axial center of the control shaft, by operating the adjustment mechanism. This reduces the vibration generated within an internal combustion engine, which would otherwise decrease the fuel efficiency.

In the above preferable embodiment, one end of the control arm is inserted into the control shaft; the adjustment mechanism has an adjusting screw member which is movable forward/rearward in the control shaft on the side opposite to the control arm, and contacts one end of the control arm; and the part contacting one end of the control arm and adjusting screw member is positioned within the oil passage of the control shaft.

According to this configuration, variations in control and between cylinders can be adjusted by a simple structure using an adjusting screw member. Further, the part between the contacting control arm end and the adjusting member end can be easily lubricated merely by a structure to position the contact portion at the oil passage in the control shaft without requiring a special structure.

In the above preferable embodiment, a notch to connect the oil passage of the control shaft and the lubricant passage of the control arm is formed on at least one of the end of the control arm and the end of the adjusting screw member contacting that end.

According to this configuration, oil is always supplied in a good condition from the oil passage of the control shaft to the lubricant passage of the control arm, by a simple structure using a notch.

In a preferable embodiment of the invention, a depression is formed in the control shaft to house a part of a connected part connecting the transmission arm and control arm.

According to this configuration, the distance between the connected portion of the control arm and the axial center of the control shaft is reduced, and the adjustment mechanism is made compact and light in weight. Further, the amount of change in the cam phase or the amount of lift per a unit rotation of the control shaft is decreased. Therefore, control with higher precision is ensured, the load in moving the transmission arm is decreased, and a reaction force or a rotation torque from the intake valve and exhaust valve can be prevented from occurring.

DETAILED DESCRIPTION OF THE INVENTION

Figure 1:
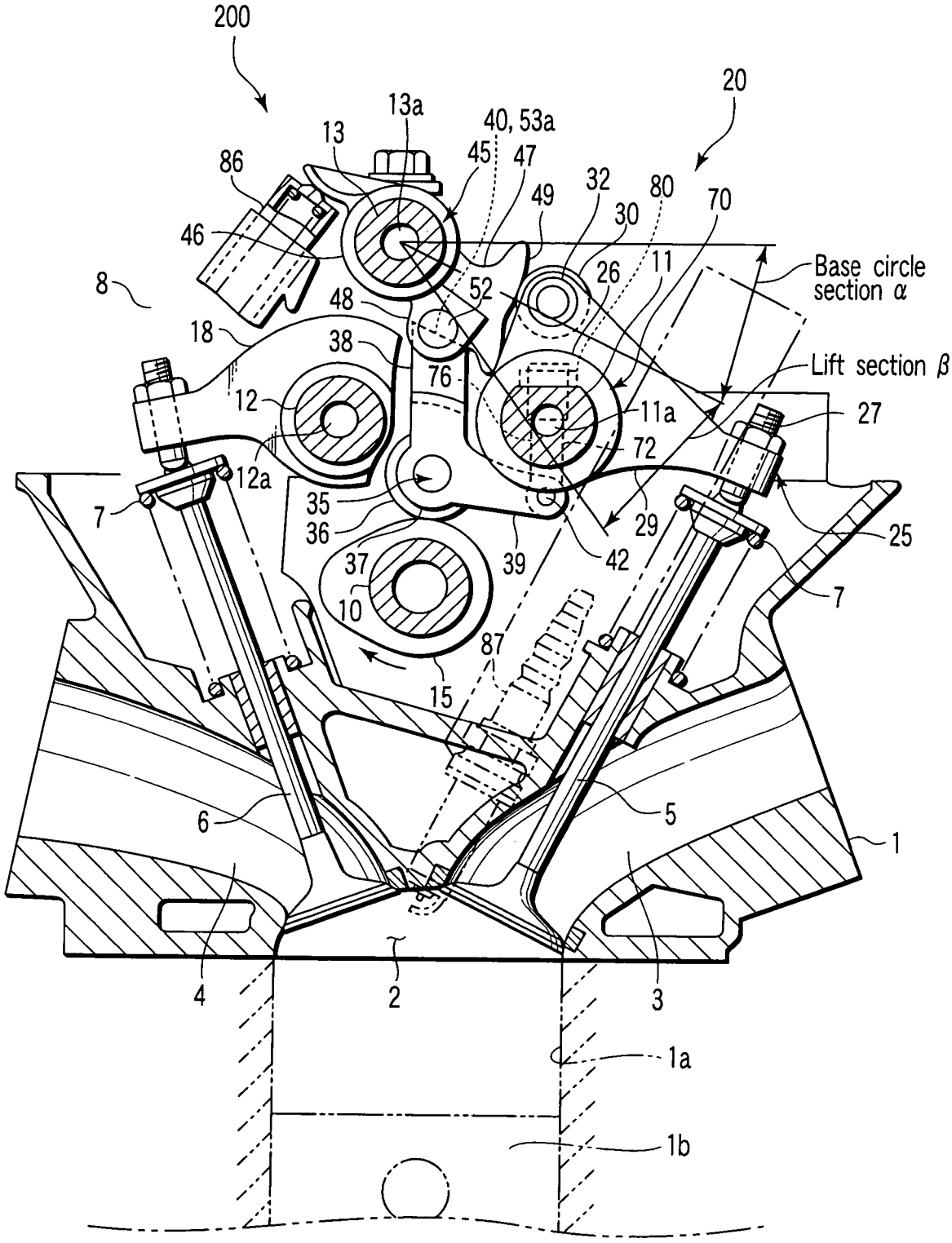
FIG. 1 is a sectional view showing a variable valve apparatus according to a first embodiment of the invention, together with a cylinder head on which the apparatus is mounted.
Figure 2:
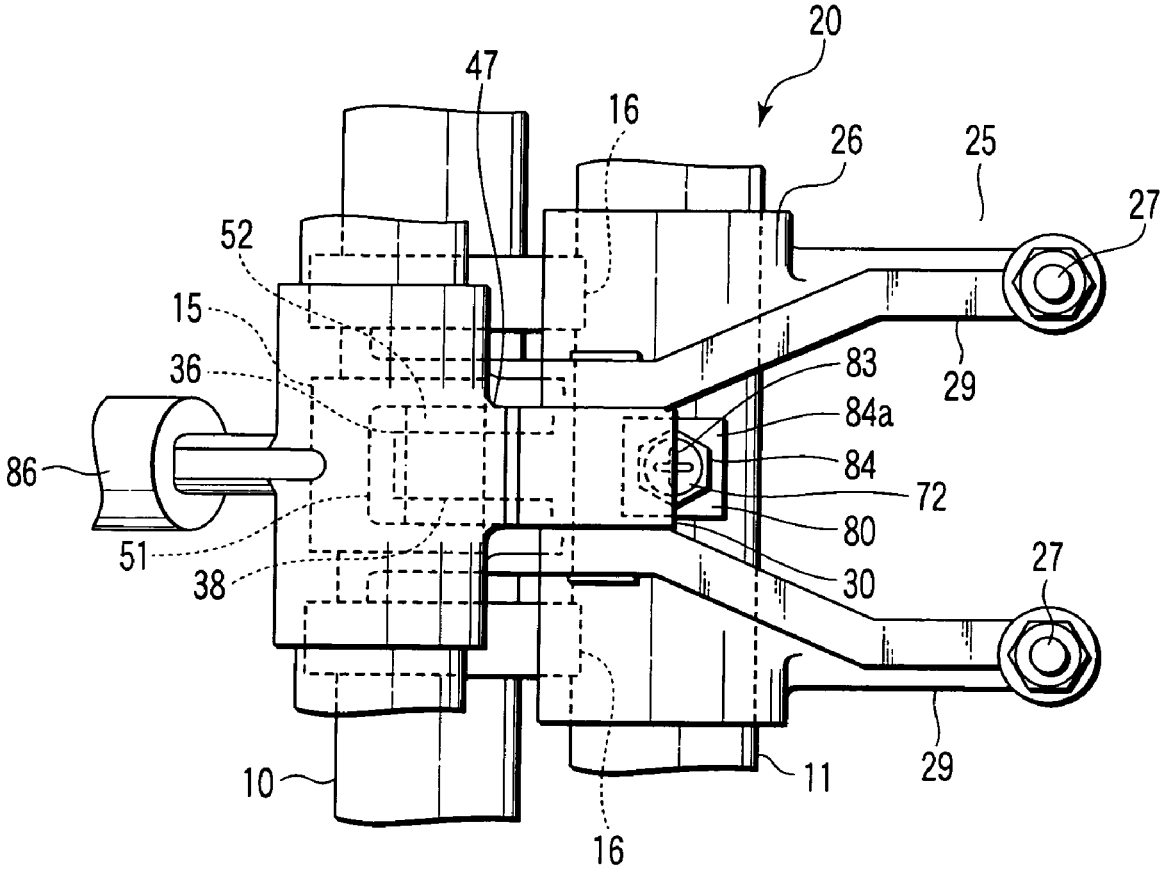
FIG. 2 is a plan view of the variable valve apparatus shown in FIG. 1.
Figure 3:
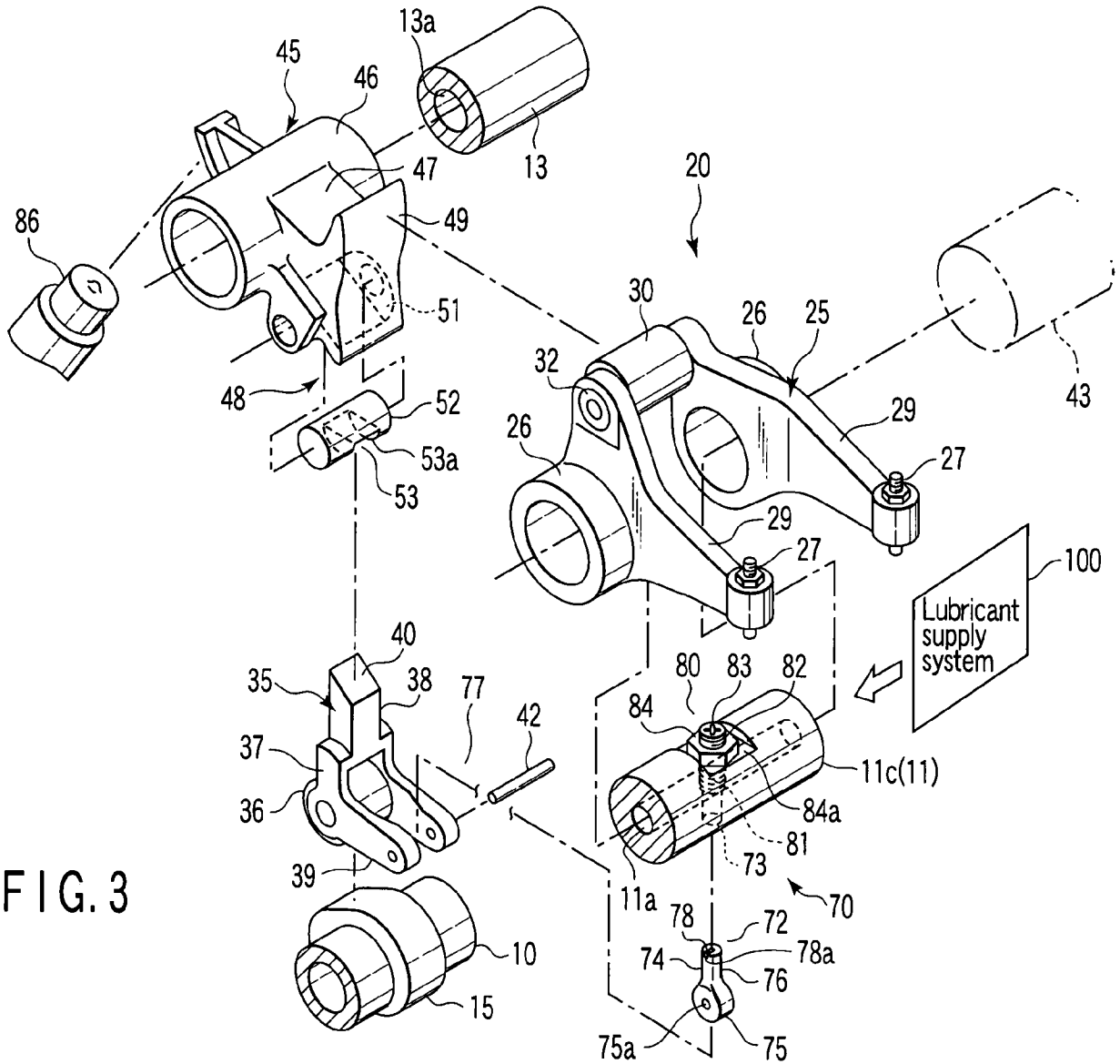
FIG. 3 is an exploded perspective view of the variable valve apparatus shown in FIG. 1.

An explanation will be given on a variable valve apparatus of an internal combustion engine according to a first embodiment of the invention by referring to FIG. 1-FIG. 11. FIG. 1 shows a sectional view of a cylinder head 1 of a reciprocating gasoline engine 200 comprising two or more cylinders 1*a* in series. The cylinder 1*a* is shown one in FIG. 1. FIG. 2 shows a plan view of the cylinder head 1. FIG. 3 is a perspective view showing a variable valve apparatus 20 mounted on the cylinder head 1 disassembled.

The cylinder head 1 will be explained with reference to FIG. 1 and FIG. 2. A combustion chamber 2 is formed for each cylinder 1*a* under the cylinder head 1. Only one combustion chamber 2 is shown in FIG. 1. The combustion chamber 2 is provided with a intake port 3 and exhaust port 4, or two of each. Only one side of the intake port 3 and exhaust port 4 is shown in the drawing.

Above the cylinder head 1, there is provided a intake valve 5 to open/close the intake port 3, and an exhaust valve 6 to open/close the exhaust port 4. The intake valve 5 and exhaust valve 6 are normally closed reciprocating valves energized by a valve spring 7 in the closing direction. A piston 1*b* is housed in the cylinder 1*a*.

A reference numeral 8 in FIG. 1 denotes a single overhead camshaft (SOHC) dynamic valve system mounted above the cylinder head 1. The SOHC dynamic valve system 8 drives two or more intake valves 5 and two or more exhaust valves 6 by one camshaft.

The dynamic valve system 8 will be explained. A reference numeral 10 denotes a hollow camshaft provided rotatably above the combustion chamber 2 in the longitudinal direction of the cylinder head 1. A reference numeral 11 denotes a rocker shaft of the intake side provided rotatably on one side opposed to the camshaft 10. The rocker shaft 11 functions also as a control shaft in the present application.

A reference numeral 12 denotes a rocker shaft of the exhaust side fixed to the opposite side of the rocker shaft 11. A reference number 13 denotes a support shaft provided between the rocker shafts 11 and 12 in the upper side and close to the rocker shaft 12.

The rocker shafts 11/12 and support shaft 13 are parallel to the camshaft 10, and composed of hollow shaft members arrange side by side one another.

Figure 4A:
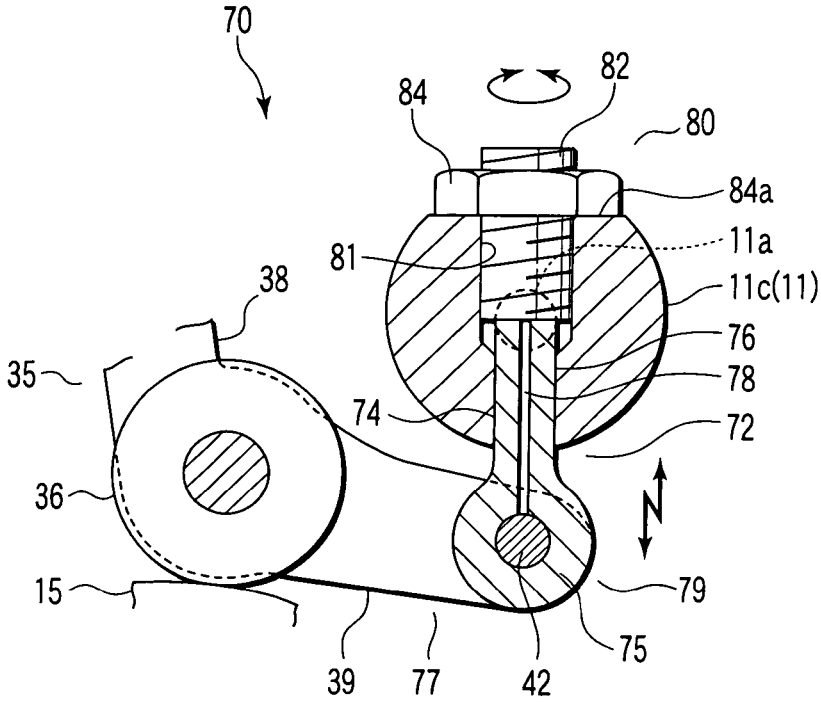
FIG. 4A is a partially sectional front view of the structure of an adjustment unit to adjust variations in the variable valve apparatus shown in FIG. 1.
Figure 4B:
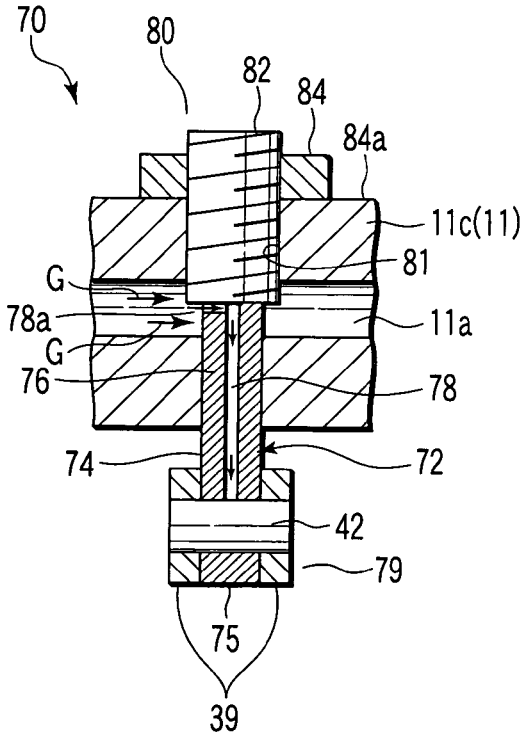
FIG. 4B is a partially sectional side view of the structure of an adjusting part to adjust variations in the variable valve apparatus shown in FIG. 1.

Passages 11*a*-13*a* formed by the inside holes of these shaft members are used to allow flow of a lubricant G supplied from a lubricant supply system 100 shown in FIG. 3. The lubricant G is shown in FIG. 4B. A reference numeral 11*a* denotes a passage formed inside the rocker shaft 11. The passage 11*a* corresponds to an oil path in the present application. A reference numeral 12*a* denotes a passage formed inside the rocker shaft 12. A reference numeral 13*a* denotes a passage formed inside the support shaft 13.

The camshaft 10 is rotated in the direction of the arrow in FIG. 1 by the output of an engine transmitted from a not-shown crankshaft. As shown in FIG. 2, the camshaft 10 is provided with one intake cam 15 and two exhaust cams 16 for each combustion chamber 2. The intake cam 15 corresponds to a cam in the present application.

The intake cam 15 is arranged at the center above the combustion chamber 2. The exhaust cams 16 are arranged one on each side of the intake cam 15.

As shown in FIG. 1, in the exhaust side rocker shaft 12, the rocker arm 18 of the exhaust valve 6 is rotatably supported for each exhaust cam 16, or each exhaust valve 6. The rocker arm 18 of only one side is shown in the drawing. In the rocker shaft 11 of the intake side, the variable valve apparatus 20 is incorporated for each intake cam 15, or intake valves 5. The rocker arm 18 is a part to transmit the displacement of the exhaust cam 16 to the exhaust valve 6. The variable valve apparatus 20 is an apparatus to transmit the displacement of the intake cam 15 to the intake valves 5.

As the rocker arm 18 and variable valve apparatus 20 are driven by the cams 15 and 16, a predetermined combustion cycle is formed within the cylinder 1*a*, to coincide with the reciprocating motion of the piston 1*b*. The predetermined cycle consists of four parts: intake, compression, ignition, and exhaust.

The variable valve apparatus 20 will be explained. As shown in FIGS. 1-3, the variable valve apparatus 20 has a rocker arm 25 supported to be rocked in the rocker shaft 11, a swing cam 45 combined with the rocker arm 25, a center rocker arm 35 to transmit the displacement of the intake cam 15 to the swing cam 45, and a valve characteristic changing mechanism 70 to move the center rocker arm 35 in the rotating direction of the intake cam 15. The rocker arm 25 is for a intake valve, and corresponds to a rocker arm in the present application. The swing cam 45 corresponds to a swing cam in the present application. The center rocker arm 35 corresponds to a transmission arm in the present application.

As shown in FIGS. 2 and 3, the rocker arm 25 has a two-branch structure. Specifically, the rocker 25 has a pair of rocker arm pieces 29, and a roller member 30.

In the rocker arm piece 29, a cylindrical rocker shaft supporting boss 26 is formed at the center, and a driving part to drive the intake valve 5, for example, an adjusting screw unit 27 is provided in one end. The roller member 30 is held between the other ends of the rocker arm piece 29, and is rotatable. The roller member 30 forms a contact part mentioned in the present invention. A reference numeral 32 denotes a short shaft to rotatably fix the roller member 30 to the rocker arm piece 29.

The rocker shaft 11 is installed rotatably between the rocker shaft supporting bosses 26. The roller member 30 is arranged close to the support shaft 13, or close to the center of the cylinder head 1. The adjusting screw unit 27 is arranged in the upper end portions of the intake valves 5, or at a valve stem end. Therefore, when the rocker arm 25 swings about the rocker shaft 11, the intake valves 5 are driven.

As shown in FIGS. 1-3, the swing cam 45 has a boss part 46, an arm part 47, and a receiver part 48. The boss part 46 is cylindrical, and rotatably installed into the support shaft 13. The arm part 47 is extended from the boss part 46 to the roller member 30, or the rocker arm 25. The receiver part 48 is formed under the arm part 47.

On the distal end surface of the arm part 47, there is formed a cam surface 49 extending in the vertical direction, for example, as a transmission surface to transmit the displacement to the rocker arm 25. The cam surface 49 rotationally contacts the peripheral surface of the roller member 30 of the rocker arm 25. The cam surface 49 will be explained in detail later.

As shown in FIG. 3, the receiver part 48 has a structure having a recessed area 51 formed on the underside of the lower part of the arm part 47 right above the cam shaft 10, and a short shaft 52 rotatably supported in the recessed area 51 in the same direction as the cam shaft 10. A reference numeral 53 denotes a cavity having a flat bottom formed in the periphery of the part of the short shaft 52 exposed into the recessed area 51.

As shown in FIG. 1 and FIG. 3, the center rocker arm 35 uses a substantially L-shaped member having a rotational contact piece, such as a cam follower 36 rotationally contacting the cam surface of the intake cam 15, and a frame-shaped holder 37 rotatably supporting the cam follower 36.

Specifically, the center rocker arm 35 is formed like an L-shape having a relay arm part 38 and a pivot arm part 39.

The relay arm part 38 is a column-shaped part extending upward from the holder 37 to between the rocker shaft 11 and support shaft 13, taking the cam follower 36 as a center. The pivot arm part 39 extends from the side of the holder 37 to the underside of a shaft part 11*c* of the rocker shaft 11 exposed between a pair of rocker arm pieces 29. The shaft part 11*c* is shown in FIGS. 6-9.

The pivot arm part 39 is divided into two branches. At the distal end, or on the upper end surface of the relay arm part 38, a slope 40 is formed as a driving surface. The slope 40 is inclined to be low in the rocker shaft 11 and high in the support shaft 13.

The distal end of the relay arm part 38 is inserted into the cavity 53 of the swing cam 45. Therefore, the center rocker arm 35 is interposed between the intake cam 15 and swing cam 45. The slope 40 of the arm part 38 slidably abutts against a receiving surface 53*a* formed at the bottom of the cavity 53. The displacement of the intake cam 15 is transmitted from the relay arm part 38 to the swing cam 45 accompanied by sliding.

As shown in FIG. 1 and FIG. 3, a valve characteristic changing mechanism 70 has an arm moving mechanism 77 and an adjustment unit 80. The arm moving mechanism 77 makes the center rocker arm 35 movable by using a control arm 72 inserted into the shaft part 11*c* from a radial direction, or a direction orthogonal to the axial center.

The adjustment unit 80 adjusts the distance from the axial center of the shaft part 11*c* to the distal end of the control arm 72, or projection of the control arm 72 from the shaft part 11*c*. The adjustment unit 80 corresponds to an adjustment mechanism in the present application.

Figure 5:
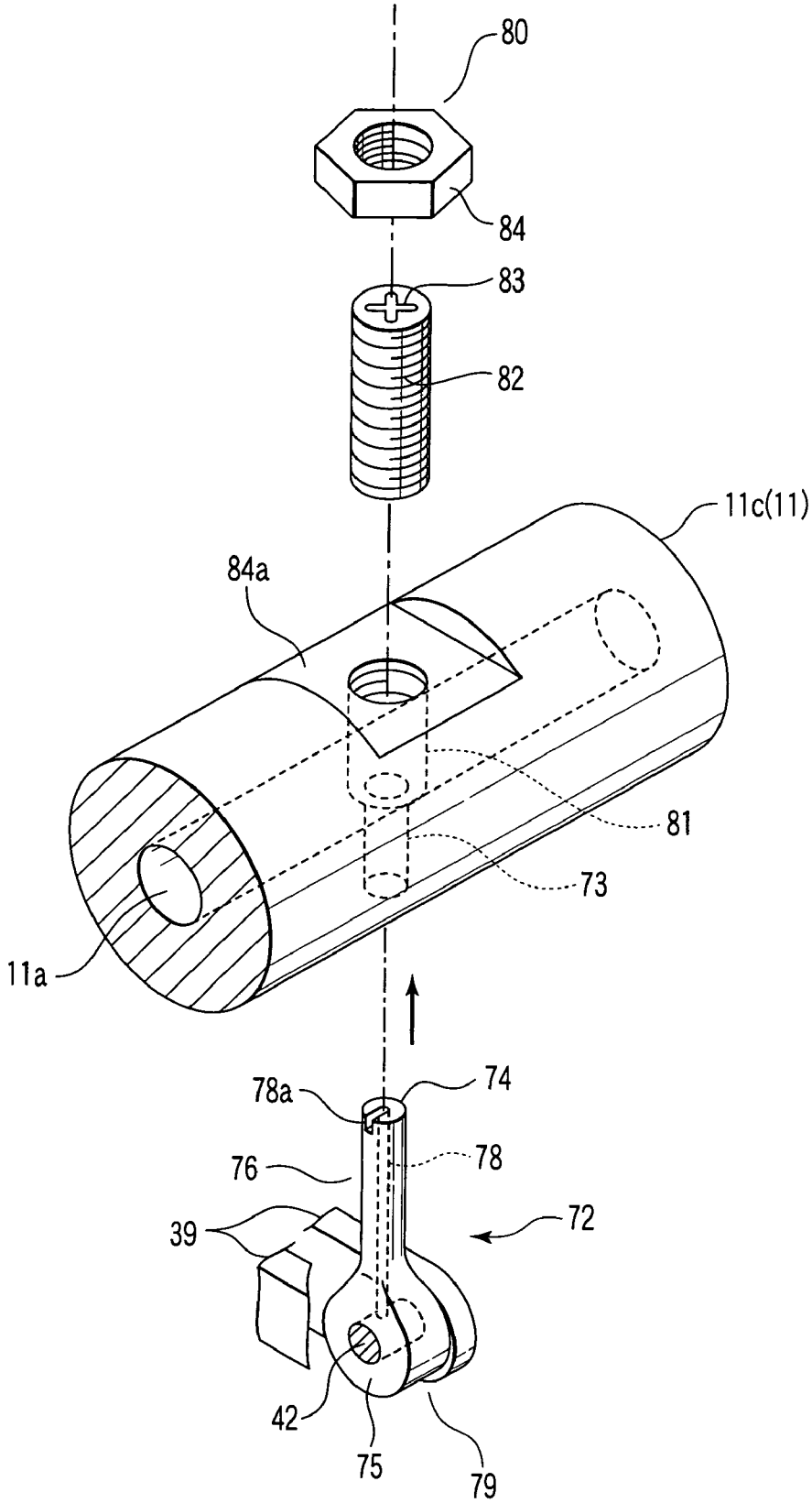
FIG. 5 is an exploded perspective view of the parts of the adjustment unit shown in FIGS. 4A and 4B.

FIGS. 3-5 show the concrete structures of the arm moving mechanism 77 and adjustment unit 80. The arm moving mechanism 77 will be explained by referring to these drawings. As shown in FIG. 5, a through hole 73 orthogonal to the axial center of the shaft part 11*c* is formed in the lower peripheral wall of the shaft part 11*c*. The through hole 73 is a hole connected to the passage 11*a*.

The control arm 72 has a shaft part 74 having a circular cross section, a circular plate-like pin connecting piece 75 formed at one end of a coaxial shaft part 74, and a support hole 75*a* formed in the pin connecting piece 75 shown in FIG. 3.

Inside the control arm 72, a lubricant passage 78 is formed along the length in the axial direction, concretely from the support hole 75*a* to the opposite side end. The lubricant passage 78 corresponds to a lubricant passage in the present application. As shown in FIGS. 4A and 4B and 5, in the end face of the other end of the shaft part 74, a groove-like notch 78*a* is formed to act as an inlet port of the lubricant passage 78. The outside diameter of the whole shaft part 74, except for the pin connecting piece 75, is shaped to be inserted into the through hole 73. In the control arm 72, the part from the pin connecting piece 75 to the opposite end portion is an adjusting area part 76. The adjusting area part 76 is inserted into the through hole 73 from the lower part of the shaft part 11*c*. The inserted adjusting area part 76 is movable in the axial direction and in the peripheral direction. The adjusting area part 76 is supported by the adjustment unit 80, described later.

The pin connecting piece 75 is inserted into the pivot arm part 39 divided into two branches. The pin 42 is inserted into the arm portion 39 and support hole 75*a*. As a result, the distal end portion of the pivot arm part 39 is connected to the end portion of the control arm 72 projected from the shaft part 11*c* rotatably in the direction orthogonal to the axial center of the camshaft 10 and rocker shaft 11, that is, they are connected together by the pin.

By this connection, as the intake cam 15 is rotated, the relay arm part 38 of the center rocker arm 35 is displaced or swung in the vertical direction. The swing cam 45 moves in unison with the movement of the center rocker arm 35, and is periodically swung about the support shaft 13, taking the short shaft 52 as a point of action, that is, a point to receive the load from the center rocker arm 35, and taking the cam surface 49 as a point of force, that is, a point to drive the rocker arm 25.

As shown in FIG. 3, the end portion of the rocker shaft 11 is connected with a control motor 43 as a control actuator. The control motor 43 rotates the rocker shaft 11 about the axial center. By the rotation of the rocker shaft 11, the control arm 72 is moved from a position arranged in a substantially vertical direction indicated in FIGS. 6 and 7, to a position largely inclined in the camshaft rotating direction shown in FIGS. 8 and 9.

Namely, as the control arm 72 is moved, the center rocker arm 35 can be moved or displaced in the direction crossing the axial direction of the shaft part 11*c*. By this movement, a point on the cam follower 36 to rotationally contact or to contact the intake cam 15 is moved or changed in an angle advancing direction or in an angle delaying direction.

By changing the rotational contact position, the position of the cam surface 49 of the swing cam 45 is changed. By the change in the position of the cam surface 49 of the swing cam 45, the open/close timing and valve lift amount of the intake valve 5 are also changed as a result.

In more detail, the distance from the center of the support shaft 13 is a changing curve surface. For example, as shown in FIG. 1, the upper side of the cam surface 49 is a base circle section α, that is, a section formed by an arc surface taking the axial center of the support shaft 13 as a center. The lower side of the cam surface 49 is a lift section β, that is, a section formed by two or more arc surfaces continued to the above arc, concretely, an arc surface similar to the cam shape in the lift area of the intake cam 15.

Therefore, when the cam follower 36 is displaced in the angle advancing direction or in the angle delaying direction of the intake cam 15, the position of the swing cam 45 is changed. By the change of the position of the swing cam 45, an area of the cam surface 49 to come in contact with the roller member 30 is changed. In more detail, while the phase of the intake cam 15 is displaced in the angle advancing direction or in the angle delaying direction, the ratio of the base circle section α to the lift section β where the roller member 30 comes and goes is changed.

As the ratio of the sections α to β is changed accompanied by a phase change in the angle advancing direction or in the angle delaying direction, the open/close timing of the intake valve 5 is adjusted to largely change the valve-closed period compared with the valve-opened period, and at the same time the lift amount of the intake valve 5 is continuously changed.

As shown in FIGS. 3-5, the adjustment unit 80 has a structure having a screw hole 81 formed at a point opposite to the through hole 73 in the shaft part 11*c*, that is, in the upper peripheral wall of the shaft part 11*c*, and a shaft-like screw member 82 inserted movably forward and rearward into the screw hole 81. The screw hole 81 is shown in FIG. 4. The screw member 82 corresponds to an adjusting screw member in the present application.

The screw hole 81 is extended to the passage 11*a* of the shaft part 11*c*. The screw hole 81 is arranged in series with the through hole 73, opposite to the passage 11*a*. The end of the control arm 72 inserted into the through hole 73 butts against the end of the screw member 82 inserted into the screw hole 81.

As the control arm 72 contacts the screw member 82 as described above, the control arm 72 is supported. As the control arm is supported, the end of the pivot arm part 39 of the center rocker arm 35 is positioned. The contact area where the control arm 72 contacts the screw member 82 is positioned to exist within the passage 11*a* of the control shaft 11. As a result, the contacted parts of the control arm 72 and screw member 82 are lubricated by the lubricant G flowing in the passage 11*a*.

The lubricant passage 78 is connected to the passage 11*a* through the notch 78*a*. The lubricant G in the passage 11*a* is sufficiently supplied from the notch 78*a*, through the lubricant passage 78, to a connected part 79 (a pin connected part) connected by the pin 42, i.e., the parts requiring lubrication, such as sliding areas where the pin 42 contacts the end of the control arm 72 and the pin 42 contacts the end of the pivot arm part 39. The distal end port of the groove-like notch 78*a* is positioned in the upstream side of the passage 11*a*, so that the lubricant G is easily led into the lubricant passage 78.

As the control arm 72 is supported as described above, the adjusting area part 76 projected from the shaft part 11*c*, or the projecting amount of the control arm 72, is adjusted by rotating the screw member 82.

A reference numeral 83 denotes a cross-shaped groove formed on the upper end face of the screw member 82, or on the end face exposed from the shaft part 11*c*. A reference numeral 84 denotes a lock nut (a nut member) screwed into the end portion of the screw member 82 opposite to the control arm 72, to lock the screw member 82. A reference numeral 84*a* denotes a notch forming a bearing surface of the lock nut 84.

As the projecting amount of the control arm 72 is variable, the positions of the center rocker arm 35 and swing cam 45 are changed by changing the rotational contact position of the intake cam 15 and center rocker arm 35, and the opening period and lift amount of the intake valve 5 are adjusted.

In FIGS. 1-3, a reference numeral 86 denotes a pusher to energize the intake cam 15, center rocker arm 35 and switch cam 45 in the direction of bringing them in close proximity. A reference numeral 87 denotes an ignition plug to ignite a mixture in the combustion chamber 2.

Next, an explanation will be given on the function of the variable valve apparatus 20 configured as described above.

As indicated by the arrow in FIG. 1, it is assumed that the camshaft 10 is rotated by operating the engine.

At this time, the cam follower 36 of the center rocker arm 35 rotationally contacts the intake cam 15, and is driven along the cam profile of the intake cam 15. Therefore, the center rocker arm 35 is swung about the pin 42 in the vertical direction.

The displacement of the center rocker arm 35 by the swinging is transmitted to the receiving surface 53*a* of the swing cam 45 through the slope 40 of the relay arm part 38. As the receiving surface 53*a* and slop 40 are slidable, the swing cam 45 is repeatedly pushed up/down by the slope 40 while sliding on the slope 40. By the swinging of the swing cam 45, the cam surface 49 is driven to reciprocate in the vertical direction.

At this time, as the cam surface 49 is rotationally contacting the roller member 30 of the rocker arm 25, the roller member 30 is periodically pressed by the cam surface 49. Receiving this depression, the rocker arm 25 is driven or swung about the rocker shaft 11 to open/close two or more, or a pair of intake valves 5.

Figure 6:
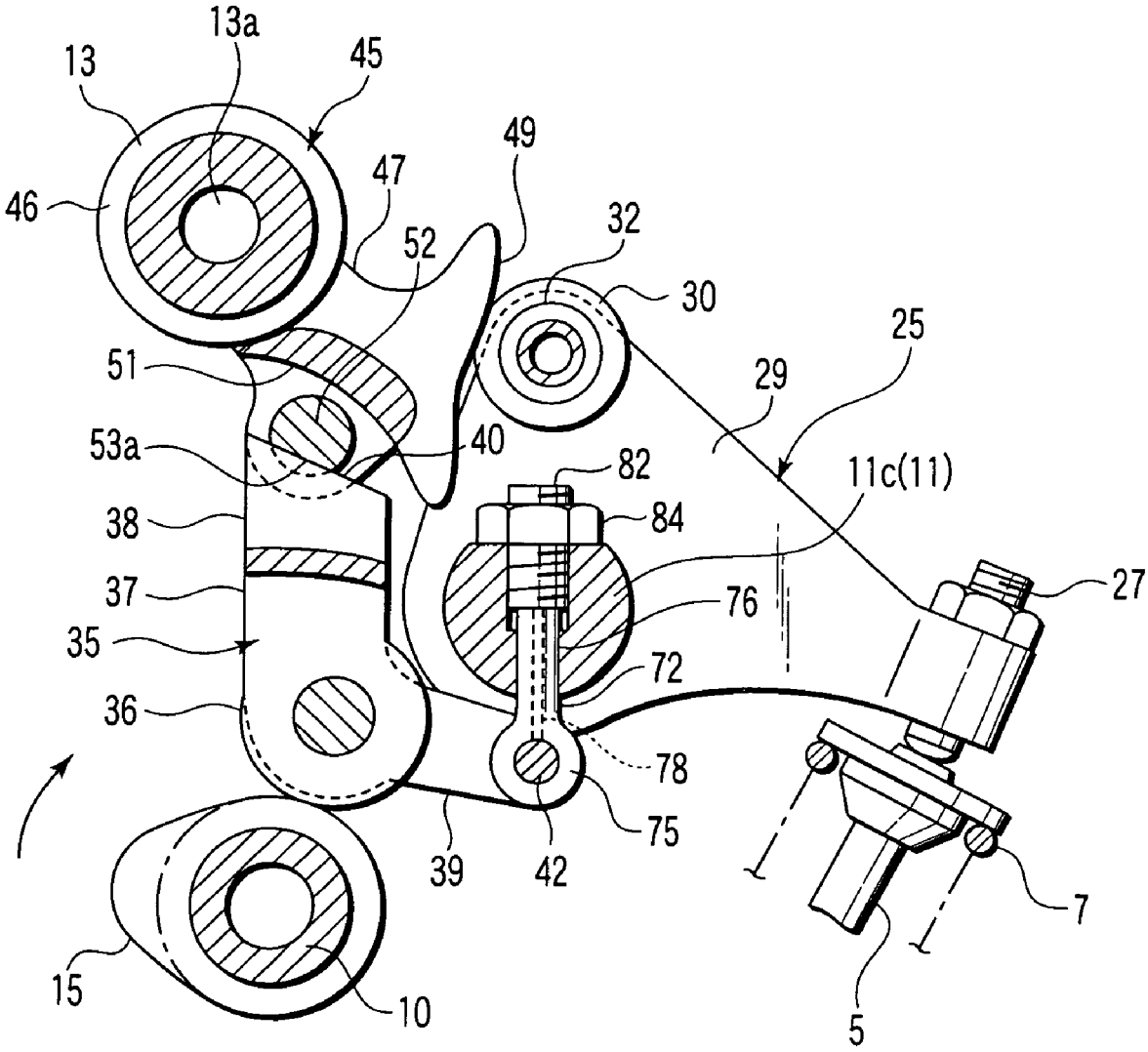
FIG. 6 is a sectional view showing the state that a rocker arm contacts a base circle section of a cam surface upon control of a maximum valve lift of the variable valve apparatus shown in FIG. 1.
Figure 7:
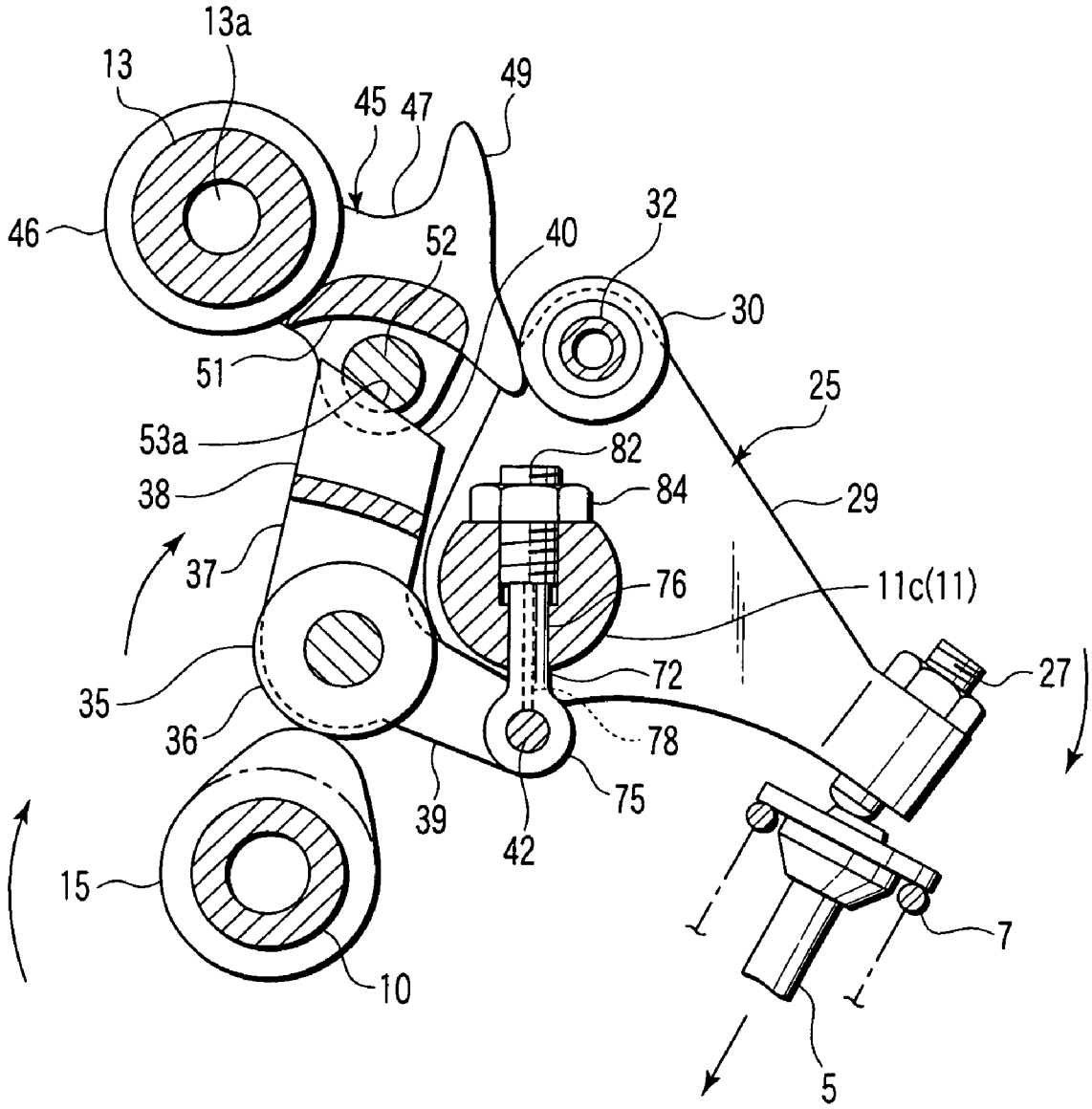
FIG. 7 is a sectional view showing the state that a rocker arm contacts a lift section of a cam surface upon control of a maximum valve lift of the variable valve apparatus shown in FIG. 1.

At this time, it is assumed that the rocker shaft 11 is rotated by the operation of the control motor 43, and the control arm 72 is rotated to a point to ensure a maximum valve lift amount, for example, the vertical position shown in FIG. 6 and FIG. 7.

Receiving the displacement of the control arm 72 by the rotation, the center rocker arm 35 moves on the intake cam 15 in the direction of rotation. Then, as shown in FIGS. 6 and 7, the rotational contact position of the center rocker arm 35 and intake cam 15 is displaced on the intake cam 15 in the angle delaying direction. As a result, the cam surface 49 of the swing cam 45 is positioned to an angle close to vertical.

By this position of the cam surface 49, as shown in FIGS. 6 and 7, an area on the cam surface 49 where the roller member 30 comes and goes, that is, the ratio of the base circle section α to the lift section β, is set to an area to provide a maximum valve lift amount, that is, a shortest base circle section α and a longest lift section β.

Therefore, the rocker arm 25 is driven by a cam surface area formed by a narrow base circle section α and a longest lift section β. As a result, the intake valve 5 is opened/closed at the timing according to a maximum valve lift amount indicated by A1 in FIG. 11, and a TPO position of a intake valve lift curve.

Figure 8:
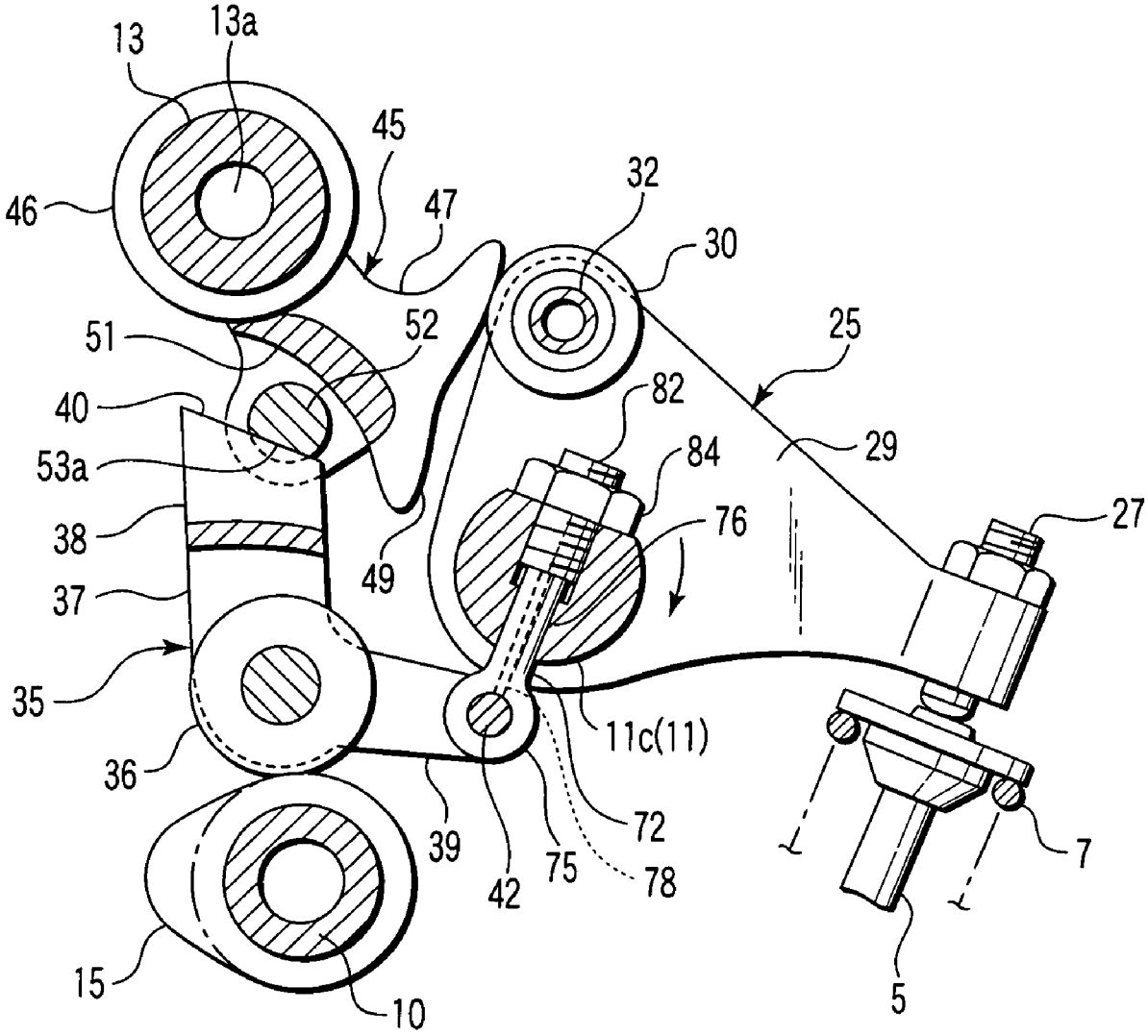
FIG. 8 is a sectional view showing the state that a rocker arm contacts a base circle section of a cam surface upon control of a minimum valve lift of the variable valve apparatus shown in FIG. 1.
Figure 9:
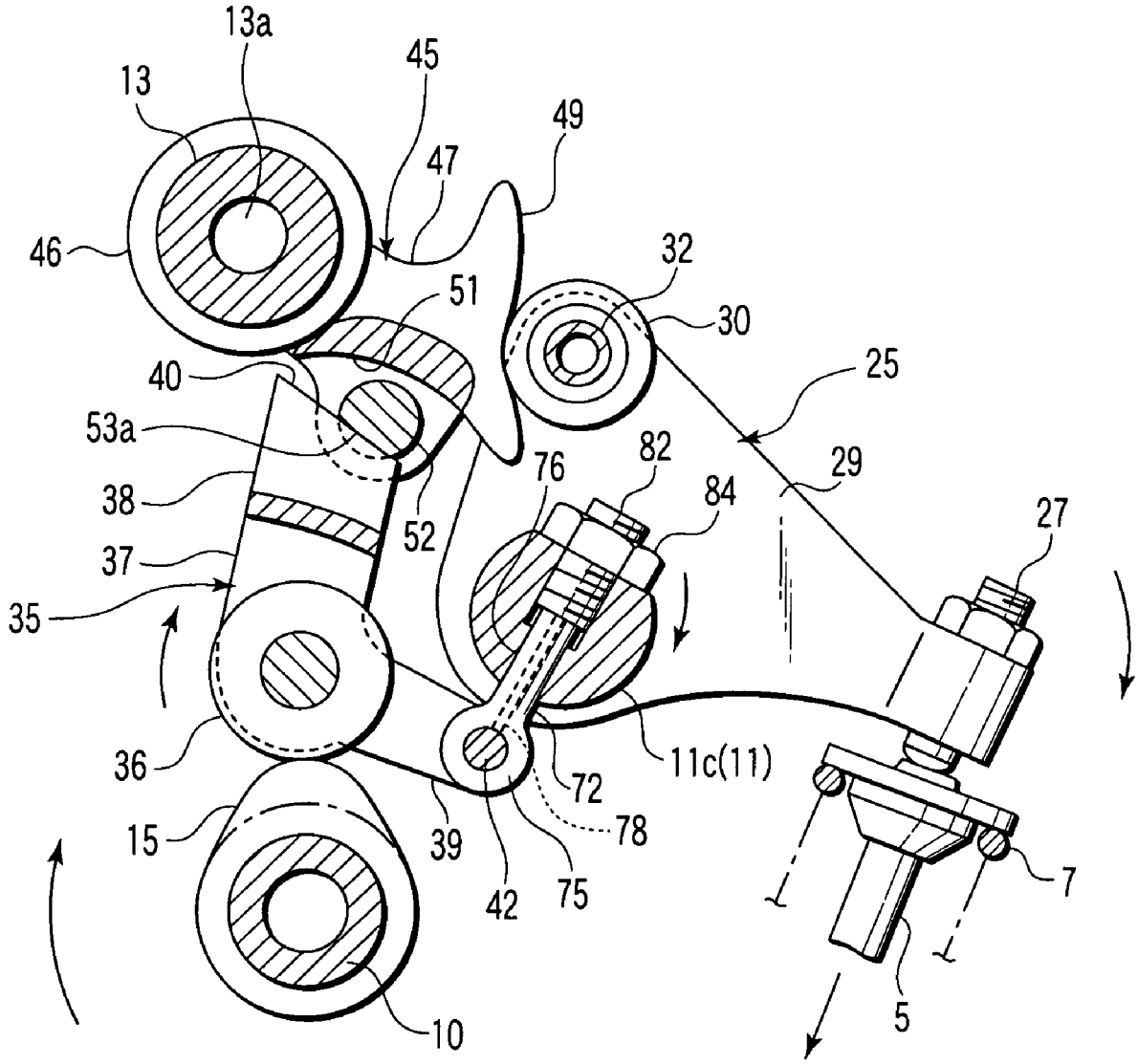
FIG. 9 is a sectional view showing the state that a rocker arm contacts a lift section of a cam surface upon control of a minimum valve lift of the variable valve apparatus shown in FIG. 1.

When reducing the lift amount of the intake valve 5 and the area to actually open the intake valve 5 in the intake cam 15 from the above state, the rocker shaft 11 is rotated by operating the control motor 43, and the control arm 72 is inclined in the direction to move the pin 42 closer to the intake cam 15, as shown in FIGS. 8 and 9.

By the displacement of the control arm 72 by the rotation, the center rocker arm 35 is moved forward in the rotation direction on the intake cam 15. The rotational contact position, or the contact position of the center rocker arm 35 and intake cam 15 is displaced in the angle advancing direction on the intake cam 15, as shown in FIGS. 8 and 9. By this change in the rotational contact position, the TOP position of the valve lift curve is moved in the angle advancing direction. The slop 40 receives the movement of the center rocker arm 35, and slides on the receiving surface 53*a* from the original position to the cam angle advancing direction.

By the movement of the center rocker arm 35, the position of the swing cam 45 is changed to a position where the cam surface 49 is inclined downward, as shown in FIGS. 8 and 9.

As the inclination is increased, the area of the cam surface 49 where the roller member 30 comes and goes, that is, the ratio of the base circle section α to the lift section β is changed to a ratio in which α gradually becomes long, and β becomes short. Namely, the cam profile of the cam surface 49 is changed. When the changed cam profile of the cam surface is transmitted to the roller member 30, the rocker arm 25 is driven to decrease the lift amount while advancing the angle of the whole cam profile.

Figure 11:
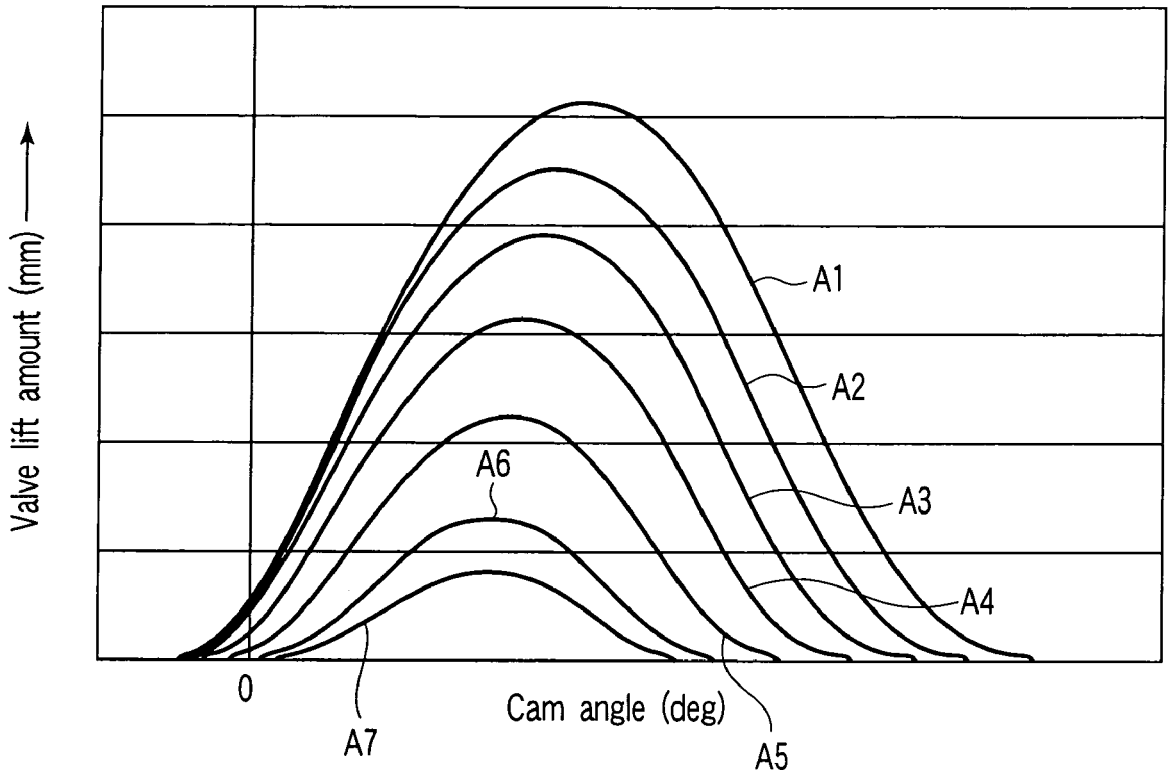
FIG. 11 is a graph showing the performance of the variable valve apparatus shown in FIG. 1.

The intake valve 5 is controlled by continuous and simultaneous changing of the open/close timing and valve lift amount while keeping the timing to open the valve without largely changing the valve-open period; in other words, by utilizing the maximum valve lift amount A1 to the minimum valve lift amount A7 obtained by the maximum inclination of the pin member 41, as shown in FIG. 11.

During this period, some of the lubricant G in the passage 11*a* supplied from the lubricant supply system 100 is led into the lubricant passage 78 in the control arm 72, as indicated by the arrow in FIG. 4B. Therefore, the part between the end of the control arm 72 and the end of the screw member 82 is lubricated. Further, the connected part 79 connected by the pin 42, i.e., the sliding portion between the pin 42 and the pin connecting piece 75, and the sliding portion between the pin 42 and the pivot arm part 39 are lubricated.

One end of the control arm 72 is inserted from the radial direction into the shaft part 11*c* corresponding to a control shaft in the present application, abutted against the end of the screw member 82, and connected rotatably about the axial center of the shaft part 74.

Therefore, even if the center rocker arm 35 as a transmission arm in the present application is displaced on the intake cam 15, and a misalignment in which the cam surface and cam follower 36 do not contact in parallel occurs during the changing operation, the behavior of the misalignment is absorbed by the movement, or the displacement of the center rocker arm 35 by the rotation about the axial center of the control arm 72.

Therefore, the cam surface of the intake cam 15 and cam follower 36 are not worn by a deflective contact and not damaged by a localized load. One end of the control arm 72 is inserted into the shaft part 11*c*, and the other end is connected with a pin to the end of the center rocker arm 35. Therefore, the connected part 79 (pin connected part) connected by the pin 42 requiring lubrication can be lubricated simply, by forming the lubricant passage 78 that leads the lubricant G in the passage 11*a* to the pin connected part within the control arm 72.

Namely, with a simple passage structure, the part connected with the pin 42 can be sufficiently lubricated. Particularly, as the notch 78*a* to lead the lubricant G from the passage 11*a* to the lubricant passage 78 is formed at the end of the control arm 72, a sufficient amount of lubricant is ensured.

Further, as the shaft part 11*c* is provided with the adjustment unit 80 to adjust the projecting length from the shaft part 11*c*, variations in control and between cylinders 1*a* can be easily adjusted. An explanation will now be given on the adjustment. This adjustment refers to adjustment due to variations in the valve-opened period of the intake valve 5.

First, the rocker shaft 11 is rotated while an engine is not operating, and the rocker shaft 11 is inclined to a position where the head, or the end with a grooved 83 of the screw member 82 is set between the rocker arm pieces 29, i.e., a position enabling work to be carried out easily.

Figure 10:
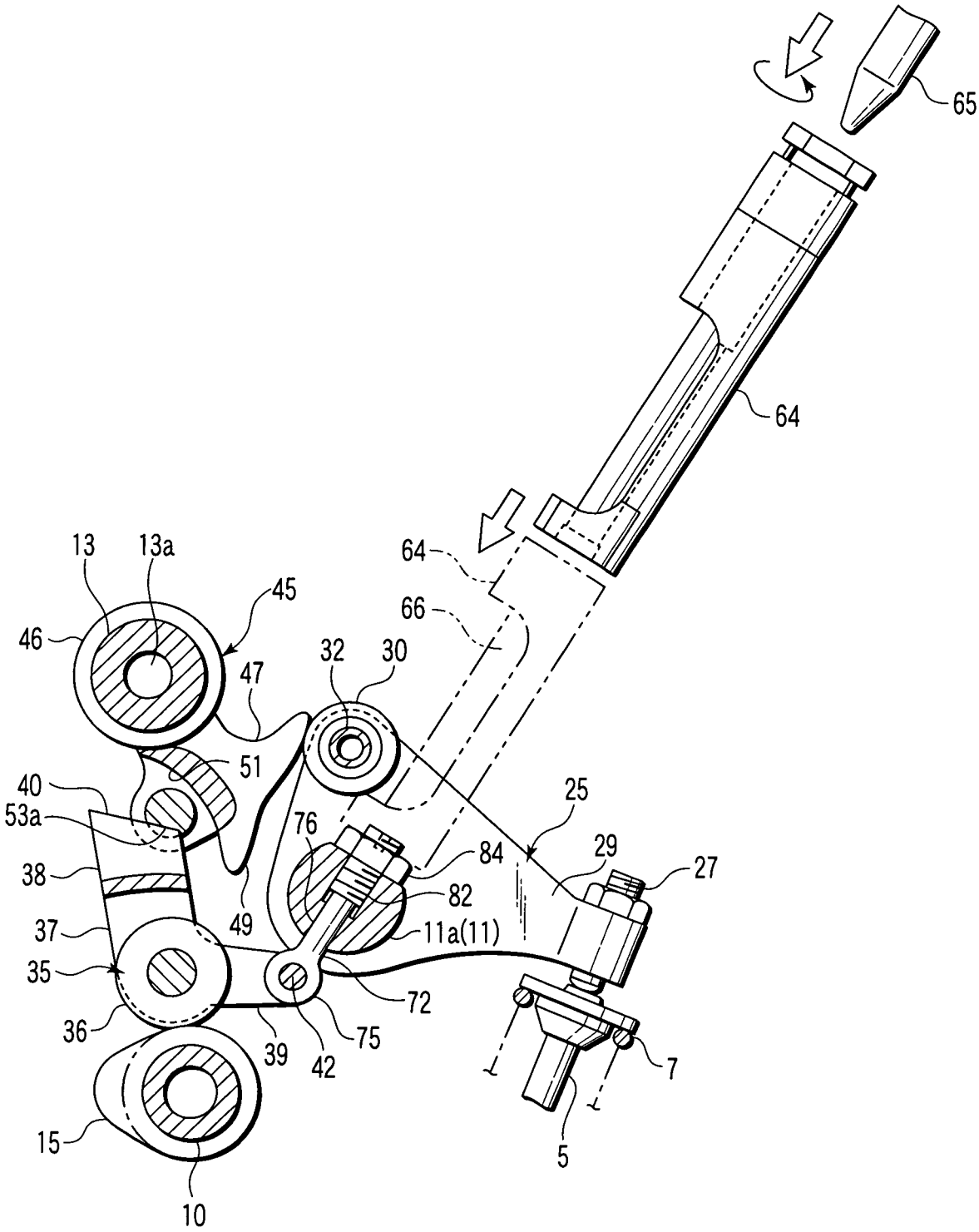
FIG. 10 is a sectional view explaining the adjustment of the variable valve apparatus shown in FIG. 1.

Then, the distal end of a driver jig 64 is fitted into the lock nut 84 through the clearance between the rocker arm pieces 29, and a guide path 66 is formed to insert a driver 65 into a place between the rear end of the driver jig 64 and the end portion of the screw member 82, as indicated by a chain double-dashed line in FIG. 10.

Then, the distal end side of the driver 65 is inserted into the guide path 66. The plus-shaped insertion portion at the distal end of the driver 65 is inserted into the cross-shaped groove 83 at the end of the screw member 82.

Then, the driver jig 64 is rotated with the driver 65 fixed, and the lock nut 84*b* is loosened. The driver 65 is rotated, and the projecting amount of the control arm 72 is adjusted. Then, the position of the center rocker arm 35 is changed. Therefore, the rotational contact position, or the contact position of the center rocker arm 35 and intake cam 15 is adjusted. By this adjustment, the position of the swing cam 45 is changed. As the driving position of the swing cam 45 to drive the rocker arm 25 is changed, the open/close phase and lift amount of the intake valve 5 are adjusted.

By the movement of the control arm 72 incorporated in the rocker shaft 11, the rotational contact position of the center rocker arm 35 and intake cam 15 is changed. By using the structure to adjust the projecting amount of the control arm 72 as a variable valve structure to change the driving range of the rocker arm 25, fine adjustment of the position of the center rocker arm 35 along the angle advancing or delaying direction becomes possible, and the rotational contact position, or the contact position of the center rocker arm 35 and intake cam 15 can be finely adjusted.

The phase of the intake valve 5 is adjusted by changing the position of the swing cam 45 and the driving position of the swing cam 45 to drive the rocker arm 25, and variations between the cylinders are corrected. Further, by the structure in which the center rocker arm 35 and control arm 72 are connected with the pin 42, the movable range of the control arm 72 is directly transmitted to the center rocker arm 35, and the range is adjusted over a wide area.

Particularly, the adjustment unit 80 has a simple structure in which the screw member 82 is inserted into the shaft part 11*c* opposite to the inserted control arm 72. In this structure, the contacting control arm 72 and screw member 82 are lubricated simply by positioning the ends of the control arm 72 and screw member 82, forming a contact area, within the passage 11*a*, and no special structure is needed.

Figure 12A:
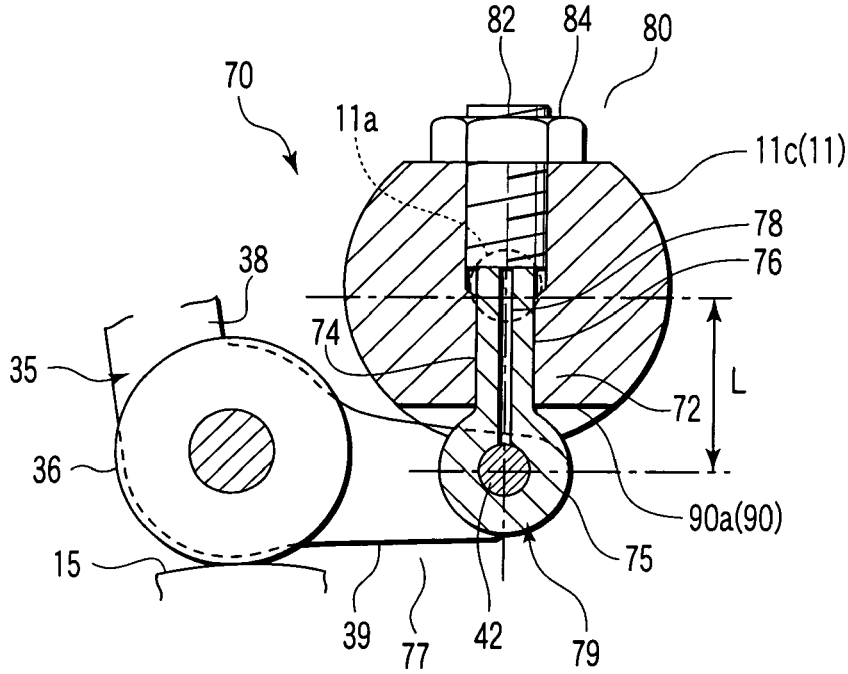
FIG. 12A is a front view showing the essential parts of a variable valve apparatus according to a second embodiment of the invention, and showing a partially sectional view of the structure of an adjustment unit to adjust variations in the variable valve apparatus.
Figure 12B:
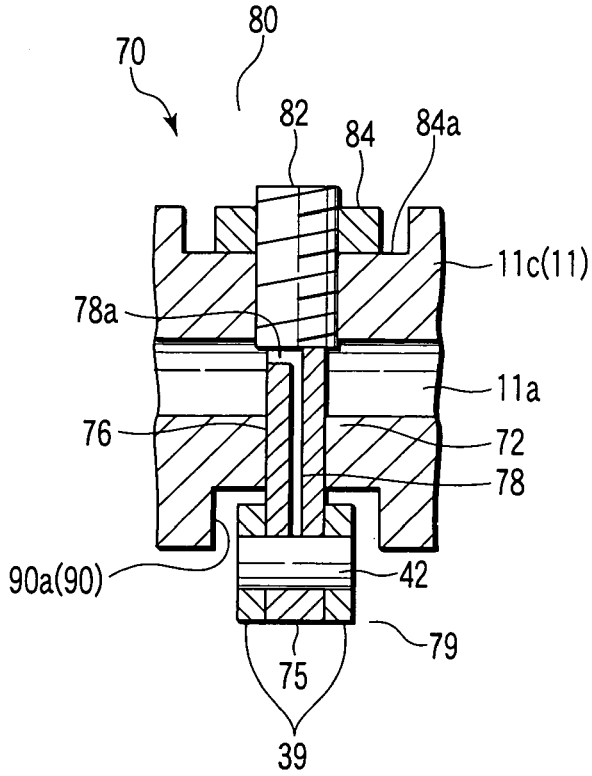
FIG. 12B is a side sectional view showing the essential parts of a variable valve apparatus according to a second embodiment of the invention, and showing a partially sectional view of the structure of an adjustment unit to adjust variations in the variable valve apparatus.

Next, an explanation will be given on a variable valve apparatus of an internal combustion engine according to a second embodiment of the invention, with reference to FIGS. 12A and 12B. FIGS. 12A and 12B show the essential parts of a second embodiment.

In this embodiment, a depression 90 is formed in the periphery of the rocker shaft 11, or a control shaft mentioned in the present invention. The depression 90 includes a pin connected part, or a part of the connected part 79 of the center rocker arm 35 and control arm 72 connected with the pin 42.

Specifically, in this embodiment, a notch 90*a* forming the depression 90 is provided in the lower part of the rocker shaft 11, or a part of the periphery of the rocker shaft 11 where the pin 42 is placed, as shown in FIGS. 12A and 12B. The notch 90*a* includes a part of the connected part 79, for example, a part of the pin 42.

By using such a housing structure, as shown in FIG. 12A, the distance L from the axial center of the pin 42 connecting the center rocker arm 35 and control arm 72, to the axial center of the rocker shaft 11 or a control shaft can be reduced. Therefore, the adjustment unit 80 can be made compact and light in weight.

Further, as the distance L between the axial centers is reduced, the amount of change in cam phase per a unit rotation of the rocker shaft 11 or the control shaft is decreased. Accordingly, the open/close timing and lift amount can be controlled with high precision. Further, a load needed to move the center rocker arm 35 or the rotation torque of the rocker shaft 11 can be decreased. In addition, a reaction force or a rotation torque from the intake valve 5 can also be decreased.

In the second embodiment, the same parts as those in the first embodiment are given the same reference numerals, and explanation on these parts are omitted.

The present invention is not limited to the embodiments described above. The invention may be embodied in other specific forms without departing from its spirit or essential characteristics. In the structures of the embodiments described above, a rocker shaft in the intake side is compatible with a control shaft. However, a control shaft may be separately provided.

In the embodiments described above, a notch is formed in a control arm. However, a notch may be formed in the end face of an adjusting screw member. The present invention is applied to a intake valve in the embodiments described above, but may be applied to an exhaust valve.

In the embodiments described above, the present invention is applied to a SOHC dynamic system engine having a structure to drive a intake valve and an exhaust valve by one camshaft. The invention may be applied a DOHC (Double Overhead Camshaft) dynamic engine, in which a camshaft is provided exclusively for each of the intake and exhaust sides.

According to the present invention, a part connecting a transmission arm and a control arm requiring lubrication can be lubricated simply by supplying a lubricant from an oil passage in a control shaft to a lubricant passage formed within the transmission arm. Therefore, a connected part is sufficiently lubricated by a simple passage structure.

What is claimed is:

1. A variable valve apparatus of an internal combustion engine comprising:

a camshaft provided rotatably in an internal combustion engine;

a cam formed in the camshaft;

a rocking cam provided movably in the combustion engine and driven by the cam;

a intake valve or an exhaust valve driven by the rocking cam;

a control shaft which is rotatably provided side by side with the camshaft in the combustion engine, and has an oil passage inside to flow oil;

a control arm whose one end is held by the control shaft, and the other end is projected from the control shaft;

an actuator which rotates the control shaft, and displaces the control arm;

a transmission arm which is rotatably connected to the other end of the control arm, and transmits the displacement of the control arm to the rocking cam; and a lubricant passage which is provided inside the control arm, and supplies oil in the oil passage of the control shaft to a part connecting the control arm and transmission arm.

2. The variable valve apparatus of an internal combustion engine according to claim 1, further comprising an adjustment mechanism, which adjusts a distance from the part connecting the control arm and transmission arm to the axial center of the control shaft.

3. The variable valve apparatus of an internal combustion engine according to claim 2, wherein a depression is formed in the control shaft to house a part of a connected part connecting the transmission arm and control arm.

4. The variable valve apparatus of an internal combustion engine according to claim 2, wherein one end of the control arm is inserted into the control shaft, and the adjustment mechanism has an adjusting screw member which is inserted movably forward/rearward in the control shaft on the side opposite to the control arm, and contacts one end of the control arm; and the part contacting one end of the control arm and adjusting screw member is positioned within the oil passage of the control shaft.

5. The variable valve apparatus of an internal combustion engine according to claim 4, wherein a depression is formed in the control shaft to house a part of a connected part connecting the transmission arm and control arm.

6. The variable valve apparatus of an internal combustion engine according to claim 4, wherein a notch to connect the oil passage of the control shaft and the lubricant passage of the control arm is formed on at least one of the end of the control arm and the end of the adjusting screw member contacting that end.

7. The variable valve apparatus of an internal combustion engine according to claim 6, wherein a depression is formed in the control shaft to house a part of a connected part connecting the transmission arm and control arm.

8. The variable valve apparatus of an internal combustion engine according to claim 1, wherein a depression is formed in the control shaft to house a part of a connected part connecting the transmission arm and control arm.

* * * * *